US011245229B2

(12) United States Patent
Ellison

(10) Patent No.: US 11,245,229 B2
(45) **Date of Patent: *Feb. 8, 2022**

(54) ELECTRICAL CONNECTOR HAVING ELECTRICALLY COMMONED GROUNDS

(71) Applicant: FCI USA LLC, Etters, PA (US)

(72) Inventor: Jason John Ellison, Dillsburg, PA (US)

(73) Assignee: FCI USA LLC, Etters, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/887,874

(22) Filed: May 29, 2020

(65) Prior Publication Data

US 2020/0295513 A1 Sep. 17, 2020

Related U.S. Application Data

(63) Continuation of application No. 16/060,188, filed as application No. PCT/US2016/065271 on Dec. 7, 2016, now Pat. No. 10,673,182.

(Continued)

(51) Int. Cl.

*H01R 9/03* (2006.01)
*H01R 13/6471* (2011.01)

(Continued)

(52) U.S. Cl.

CPC ..... *H01R 13/6471* (2013.01); *H01R 9/03* (2013.01); *H01R 9/2483* (2013.01); *H01R 12/596* (2013.01); *H01R 13/567* (2013.01); *H01R 13/6592* (2013.01); *H01R 13/65914* (2020.08); *H01R 24/22* (2013.01); *H01R 24/60* (2013.01); *H01R 13/6581* (2013.01); *H01R 13/6586* (2013.01); *H01R 13/6596* (2013.01)

(58) Field of Classification Search

CPC ..... H01R 13/6471; H01R 13/65914; H01R 9/03; H01R 9/2483; H01R 12/596; H01R 13/567; H01R 13/6592; H01R 24/22; H01R 24/60; H01R 13/6581; H01R 13/6586; H01R 13/6596

See application file for complete search history.

(56) References Cited

U.S. PATENT DOCUMENTS 5,190,473 A 3/1993 Mroczkowski et al.
5,281,150 A 1/1994 Bundga et al.

(Continued)

FOREIGN PATENT DOCUMENTS

CN 1168547 A 12/1997
CN 1271190 A 10/2000

(Continued)

OTHER PUBLICATIONS

Extended European Search Report for European Application No. 14855318.3 dated Apr. 21, 2017.

(Continued)

*Primary Examiner* — Truc T Nguyen
(74) *Attorney, Agent, or Firm* — Wolf, Greenfield & Sacks, P.C.

(57) ABSTRACT

A ground shield includes a plurality of contact members configured to contact the ground contacts of a column of contacts of an electrical connector, so as to electrically common the grounds to each other.

22 Claims, 5 Drawing Sheets

Related U.S. Application Data

(60) Provisional application No. 62/264,099, filed on Dec. 7, 2015.

(51) Int. Cl.

| | |
|---|---|
| ***H01R 13/6591*** | (2011.01) |
| ***H01R 9/24*** | (2006.01) |
| ***H01R 12/59*** | (2011.01) |
| ***H01R 13/56*** | (2006.01) |
| ***H01R 13/6592*** | (2011.01) |
| ***H01R 24/22*** | (2011.01) |
| ***H01R 24/60*** | (2011.01) |
| *H01R 13/6586* | (2011.01) |
| *H01R 13/6596* | (2011.01) |
| *H01R 13/6581* | (2011.01) |

(56) References Cited

U.S. PATENT DOCUMENTS

| | | | | |
|---|---|---|---|---|
| 5,480,327 | A | 1/1996 | Zola | |
| 5,961,348 | A | 10/1999 | Murphy | |
| 6,089,916 | A | 7/2000 | Kuo | |
| 6,817,898 | B2 | 11/2004 | Tanaka et al. | |
| 7,025,634 | B1 | 4/2006 | Swantner et al. | |
| 7,510,439 | B2 | 3/2009 | Gordon et al. | |
| 8,253,021 | B2 | 8/2012 | Adachi et al. | |
| 8,772,636 | B2 | 7/2014 | Yamaguchi et al. | |
| 10,109,937 | B2 | 10/2018 | Zerebilov et al. | |
| 10,468,829 | B2 | 11/2019 | Zerebilov et al. | |
| 10,673,182 | B2 | 6/2020 | Ellison | |
| 2001/0031579 | A1 | 10/2001 | Fujino et al. | |
| 2002/0136519 | A1 | 9/2002 | Tinucci et al. | |
| 2003/0038686 | A1 | 2/2003 | Tripathi et al. | |
| 2004/0127078 | A1 | 7/2004 | Tondreault et al. | |
| 2004/0242066 | A1 | 12/2004 | Ito et al. | |
| 2006/0068640 | A1 | 3/2006 | Gailus | |
| 2007/0287332 | A1 | 12/2007 | Gordon et al. | |
| 2009/0188716 | A1 | 7/2009 | Nagase | |
| 2011/0100694 | A1 | 5/2011 | Regnier et al. | |
| 2012/0145429 | A1 | 6/2012 | Nordin et al. | |
| 2012/0302096 | A1 | 11/2012 | Ellison | |
| 2013/0034977 | A1 | 2/2013 | Cina et al. | |
| 2013/0130547 | A1 | 5/2013 | Simpson et al. | |
| 2013/0149899 | A1 | 6/2013 | Schroll et al. | |
| 2013/0188325 | A1 | 7/2013 | Garman et al. | |
| 2013/0273781 | A1 | 10/2013 | Buck et al. | |
| 2013/0337667 | A1 | 12/2013 | Szczesny et al. | |
| 2014/0017950 | A1 | 1/2014 | Peloza | |
| 2014/0057493 | A1 | 2/2014 | De Geest et al. | |
| 2014/0087589 | A1 | 3/2014 | Yu | |
| 2014/0242844 | A1 | 8/2014 | Wanha et al. | |
| 2016/0028189 | A1 | 1/2016 | Resendez et al. | |
| 2016/0036165 | A1 | 2/2016 | Phillips et al. | |
| 2016/0111824 | A1 | 4/2016 | Phillips | |
| 2016/0240978 | A1 | 8/2016 | Yan et al. | |
| 2016/0268739 | A1 | 9/2016 | Zerebilov et al. | |
| 2016/0322760 | A1* | 11/2016 | Long | H01R 13/6587 |
| 2017/0018880 | A1 | 1/2017 | Phillips et al. | |
| 2018/0166830 | A1 | 6/2018 | Feng et al. | |
| 2018/0317335 | A1 | 11/2018 | An et al. | |
| 2018/0358752 | A1 | 12/2018 | Ellison | |
| 2018/0366880 | A1 | 12/2018 | Zerebilov et al. | |
| 2020/0287333 | A1* | 9/2020 | Chen | H01R 13/514 |
| 2021/0066862 | A1* | 3/2021 | Chen | H01R 13/6471 |
| 2021/0098939 | A1* | 4/2021 | Wu | H01R 13/6587 |

FOREIGN PATENT DOCUMENTS

| | | | |
|---|---|---|---|
| CN | 101743667 | A | 6/2010 |
| CN | 101783449 | A | 7/2010 |
| CN | 101916931 | A | 12/2010 |
| CN | 102142645 | A | 8/2011 |
| CN | 202153592 | U | 2/2012 |
| CN | 102969622 | A | 3/2013 |
| CN | 103178408 | A | 6/2013 |
| CN | 203150746 | U | 8/2013 |
| CN | 103378434 | A | 10/2013 |
| CN | 103378495 | A | 10/2013 |
| CN | 203242849 | U | 10/2013 |
| CN | 103515796 | A | 1/2014 |
| CN | 103999292 | A | 8/2014 |
| CN | 104009303 | A | 8/2014 |
| CN | 204179390 | U | 2/2015 |
| CN | 105051978 | A | 11/2015 |
| CN | 105612671 | A | 5/2016 |
| EP | 0 997 756 | A2 | 5/2000 |
| EP | 2 169 770 | A2 | 3/2010 |
| JP | 2010-153191 | A | 7/2010 |
| JP | 2014-229597 | A | 12/2014 |
| TW | M441942 | U1 | 11/2012 |
| TW | M485551 | U | 9/2014 |
| TW | 201521295 | A | 6/2015 |
| WO | 2015061390 | A1 | 4/2015 |

OTHER PUBLICATIONS

International Search Report and Written Opinion for International Application No. PCT/US2014/061681 dated Jan. 27, 2015.
International Preliminary Report on Patentability for International Application No. PCT/US2014/061681 dated May 6, 2016.
International Search Report and Written Opinion for International Application No. PCT/US2016/065271 dated Mar. 24, 2017.
International Preliminary Report on Patentability for International Application No. PCT/US2016/065271 dated Jun. 21, 2018.
Taiwanese Office Action dated Aug. 13, 2020 in connection with Taiwanese Application No. 105140500.
U.S. Appl. No. 16/060,188, filed Jun. 7, 2018, Ellison.
EP 14855318.3, dated Apr. 21, 2017, Extended European Search Report.
PCT/US2014/061681, dated Jan. 27, 2015, International Search Report and Written Opinion.
PCT/US2014/061681, dated May 6, 2016, International Preliminary Report on Patentability.
PCT/US2016/065271, dated Mar. 24, 2017, International Search Report and Written Opinion.
PCT/US2016/065271, dated Jun. 21, 2018, International Preliminary Report on Patentability.
TW 105140500, dated Aug. 13, 2020, Taiwanese Office Action.

* cited by examiner

ELECTRICAL CONNECTOR HAVING ELECTRICALLY COMMONED GROUNDS

CROSS-REFERENCE TO RELATED APPLICATIONS

This Application is a Continuation of U.S. application Ser. No. 16/060,188, filed Jun. 7, 2018, entitled "ELECTRICAL CONNECTOR HAVING ELECTRICALLY COMMONED GROUNDS", which is a national stage filing under 35 U.S.C. 371 of International Patent Application Serial No. PCT/US2016/065271, filed Dec. 7, 2016, entitled "ELECTRICAL CONNECTOR HAVING ELECTRICALLY COMMONED GROUNDS", which claims priority to and the benefit of U.S. Provisional Application Ser. No. 62/264,099, filed Dec. 7, 2015, entitled "ELECTRICAL CONNECTOR HAVING ELECTRICALLY COMMON GROUNDS". The entire contents of these applications are incorporated herein by reference in their entirety.

BACKGROUND

Electrical connectors include dielectric or electrically insulative connector housings, and a plurality of electrical contacts supported by the housing. The electrical contacts define mating ends that are configured to mate with a complementary electrical connector. The mounting ends are configured to be mounted to a complementary electrical component. In some applications, the mounting ends are configured to be placed in communication with conductive cables that include electrical signal conductors and drain wires. Operation of the electrical connector can produce unwanted noise at certain operating frequencies. It is desirable to provide an electrical connector that substantially reduces the noise at a desired operating frequency of the electrical connector.

SUMMARY

In accordance with one example, an electrical connector includes an electrically insulative connector housing, a plurality electrical signal contacts supported by the connector housing, and a plurality of ground contacts supported by the connector housing. Each of the signal contacts has a mating end and a mounting end, and each of the ground contacts has a mating end and a mounting end. The electrical connector defines a plurality of columns that are spaced from each other along a lateral direction and each includes the mating ends of a plurality of the signal contacts and the mating ends of a plurality of ground contacts. The electrical connector can further include an electrically conductive ground shield that is disposed between a first one of the columns and a second one of the columns with respect to the lateral direction. The ground shield can have a shield body that defines a first side and a second side opposite the first side along the lateral direction. The ground shield can include a plurality of contact members that extend out with respect to the shield body and are in contact with a respective at least two of the ground contacts, respectively, of the first one of the columns. The shield body can face at least one of the signal contacts of the first one of the columns and can be spaced along the lateral direction from the at least one of the signal contacts of the first one of the columns so as to define a gap therebetween.

BRIEF DESCRIPTION OF THE DRAWINGS

The foregoing summary, as well as the following detailed description of example embodiments of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1:
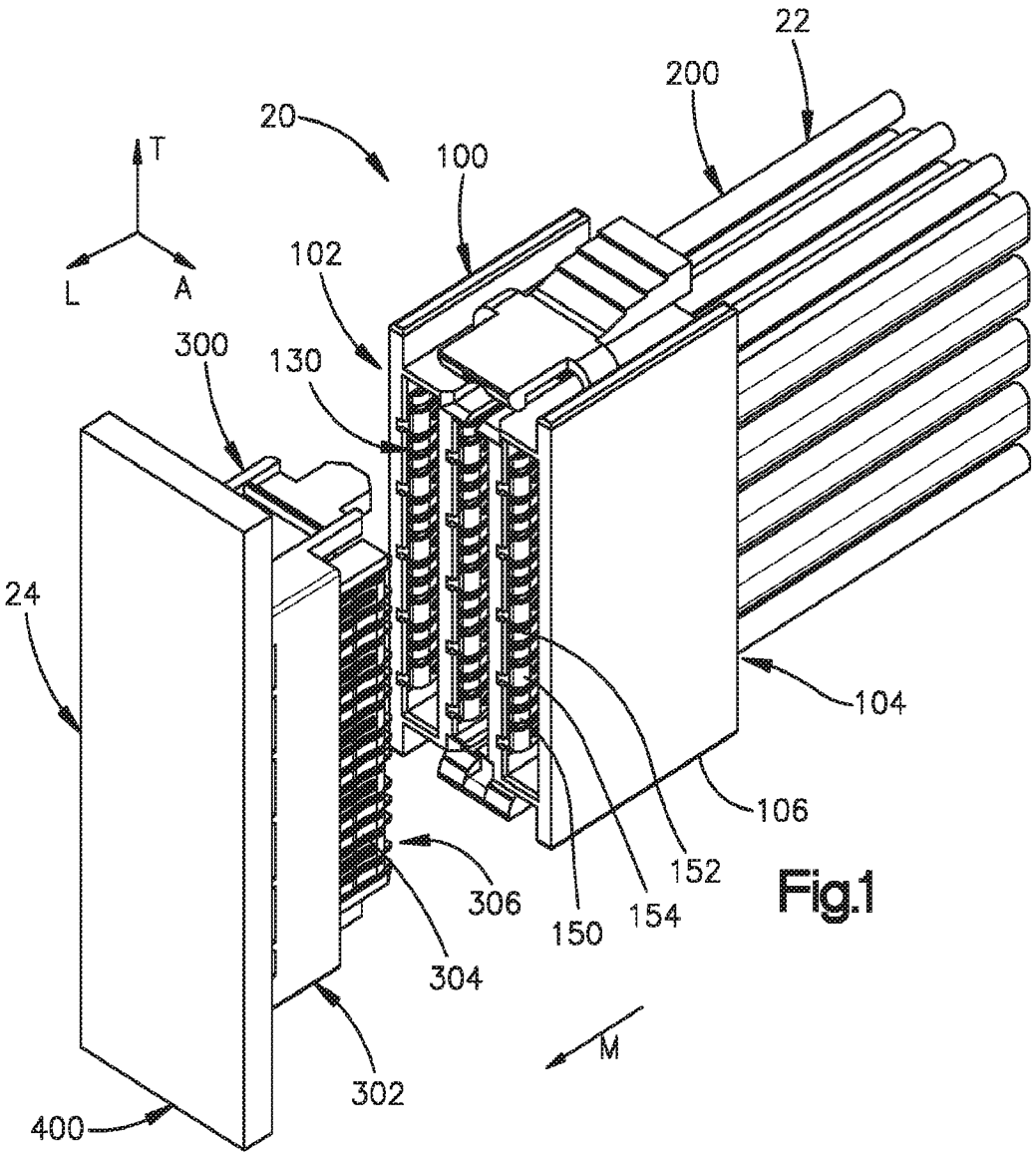
FIG. 1 is an exploded perspective view of an electrical connector system constructed in accordance with one embodiment, including a first electrical connector and a second electrical connector.

For convenience, the same or equivalent elements in the various embodiments illustrated in the drawings have been identified with the same reference numerals. Referring initially to FIG. 1, an electrical connector system 20 constructed in accordance with one embodiment can include a first electrical connector assembly 22 and a second or complementary electrical connector assembly 24. The first electrical connector assembly 22 is configured to be mated with the second or complementary electrical connector assembly 24 in a forward mating direction M that is along a longitudinal direction L. The first electrical connector assembly 22 can include a first electrical connector 100 and at least one first electrical component such as at least one electrical cable 200, including a plurality of electrical cables 200. The complementary electrical assembly 24 can include a complementary or second electrical connector 300 and a second electrical component such as a substrate 400 that can be configured as a printed circuit board. The substrate 400 can be provided as a backplane, midplane, daughtercard, or the like. The electrical cables 200 can be configured as signal cables.

The first and second electrical connectors 100 and 300 can be configured to be mated with each other so as to establish an electrical connection between the first and second electrical connectors 100 and 300, and thus between the first and complementary electrical connector assemblies 22 and 24, respectively. The first electrical connector 100 can be configured to be mounted to the plurality of electrical cables 200 so as to place the first electrical connector 100 in electrical communication with the plurality of electrical cables 200. Similarly, the second electrical connector 300 can be configured to be mounted to the substrate 400 so as to establish an electrical connection between second electrical connector 300 and the substrate 400. Thus, the electrical cables 200 can be placed in electrical communication with the substrate 400 when the first and second electrical connectors 100 and 300 are mounted to the electrical cables 200 and the substrate 400, respectively, and mated to each other.

The first electrical connector assembly 22 can be referred to as an electrical cable assembly, including the first electrical connector 100 that can be referred to as a cable connector configured to be mounted to the plurality of electrical cables 200 so as to place the first electrical connector 100 in electrical communication with each of the plurality of electrical cables 200. The first electrical connector 100 can include a dielectric or electrically insulative connector housing 106 and a plurality of electrical contacts 150 that are supported by the connector housing 106. The plurality of electrical contacts 150 can include a plurality of signal contacts 152 and a plurality of ground contacts 154.

Figure 2:
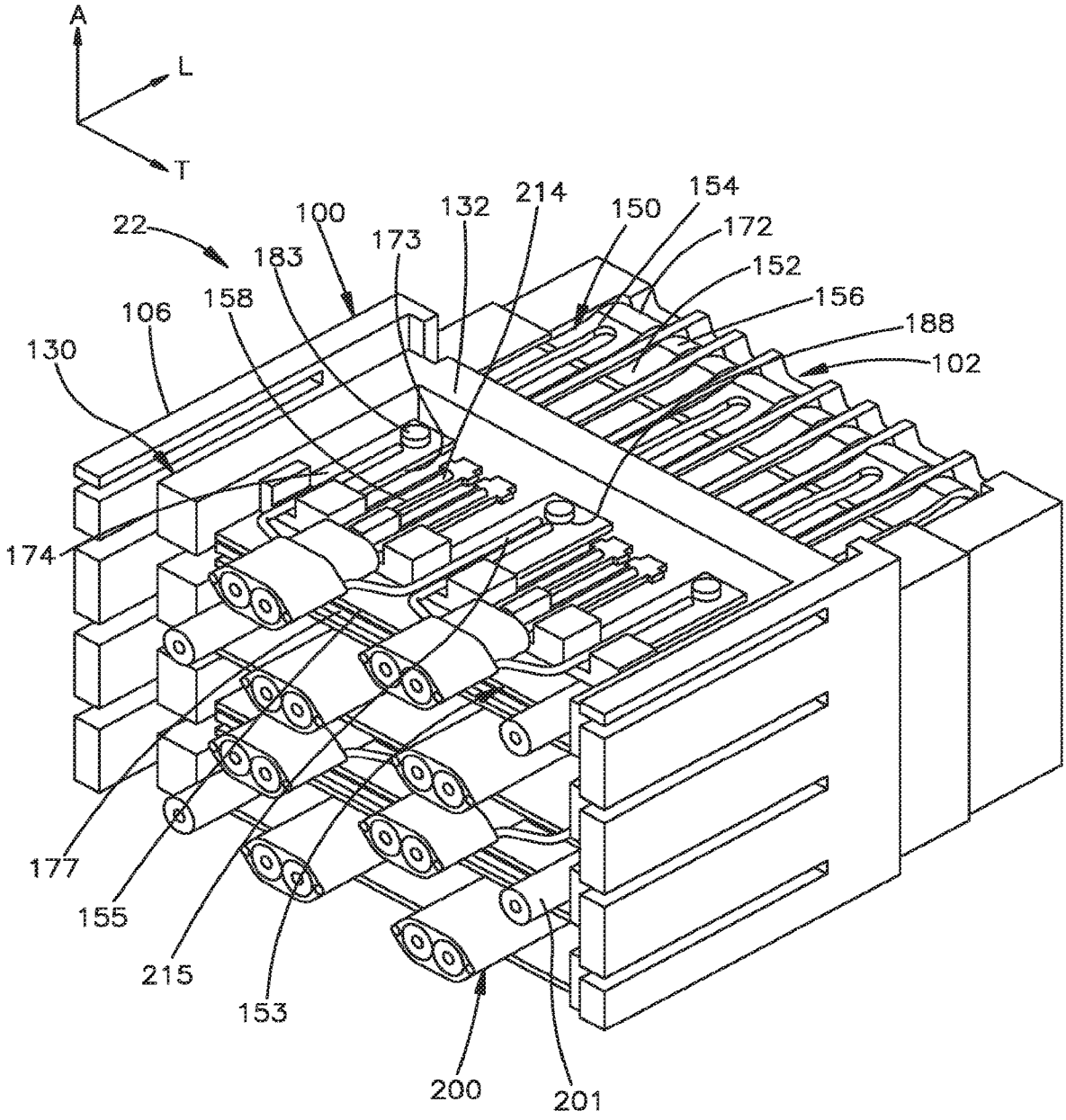
FIG. 2 is a perspective view of a portion of the first electrical connector illustrated in FIG. 1.

Referring now to FIGS. 1-2, the first electrical connector 100 can include a plurality of leadframe assemblies 130 that are supported by the connector housing 106. Each of the leadframe assemblies 130 can include a dielectric or electrically insulative leadframe housing 132 and respective ones of the plurality of the electrical contacts 150 supported by the leadframe housing 132. For instance, the electrical contacts 150 can be supported by respective ones of the leadframe housings 132 so as to define corresponding leadframe assemblies. It can be said that the electrical contacts 150 are supported by both the respective leadframe housing 132 and the connector housing 106. The electrical contacts 150 define opposed broadsides that face the lateral direction A, and opposed edges that face the transverse direction T.

In accordance with the illustrated embodiment, the first electrical connector 100 is constructed as a vertical electrical connector. In particular, the connector housing 106 defines a mating interface 102 that is configured to engage a complementary mating interface of the second electrical connector 300 when the first and second electrical connectors 100 and 300 mate with each other. The connector housing 106 further defines a mounting interface 104 that is configured to engage the electrical cables 200 when the first electrical connector 100 is mounted to the electrical cables 200. The mating interface 102 can be oriented parallel to the mounting interface 104. Further, the electrical contacts 150 include electrical signal contacts 152 and ground contacts 154.

The electrical signal contacts 152 define respective mating ends 156 and mounting ends 158 opposite the mating ends 156. The mating ends 156 can be disposed proximate to the mating interface 102, and the mounting ends 158 can be disposed proximate to the mounting interface 104. The mating ends 156 are configured to mate with complementary mating ends of electrical signal contacts of the second electrical connector 300, and respective mounting ends 158 that are configured to be placed in physical and electrical contact with, for instance mounted to, respective signal conductors 202 of the electrical cables 200. The mating ends 156 are oriented parallel to the mounting ends 158, such that the electrical signal contacts 152 can be referred to as vertical contacts. Alternatively, the first electrical connector 100 can be configured as a right-angle electrical connector whereby the mating interface 102 and the mounting interface 104 are oriented perpendicular with respect to each other, and the mating ends 156 and the mounting ends 158 are oriented perpendicular to each other.

The electrical ground contacts 154 define respective ground mating ends 172, respective ground mounting ends 174 opposite the ground mating ends 172, and respective intermediate portions 173 that extend from the respective ground mating ends 172 to the respective ground mounting ends 174. The ground mating ends 172 are spaced from the ground mounting ends 174 in the forward direction. When the connector 100 includes the leadframe assemblies described above, the ground mating ends 172 can extend out from the leadframe housing 132 in the forward direction, and can be disposed proximate to the mating interface 102. The ground mounting ends 174 can be disposed proximate to the mounting interface 104. At least one or more up to all of the ground contacts 154 can define an opening 188 that extends therethrough along the lateral direction. Thus, the opening 188 extends from one of the broadsides to the opposed broadside. In particular, the opening 188 extends through the intermediate portion at a location proximate to the ground mating end 172. That is, the opening 188 is disposed closer to the ground mating end 172 than to the ground mounting end 174. The openings 188 can be disposed within the footprint of the leadframe housing 132. Thus, the openings 188 can be aligned with the leadframe housing 132 along the lateral direction A. The openings 188 can be round, such as cylindrical, though it should be appreciated that the openings can be sized and shaped in any manner desired. As will be described in more detail below, the electrical connector 100 includes a plurality of ground shields 177 having projections 183 that are configured to be inserted into respective ones of the openings 188 so as to attach each of the ground shields 177 to respective ground contacts 154 that lie in a common one of the columns.

The ground mating ends 172 and the mating ends 156 of the electrical signal contacts 152 of each leadframe assembly 130 can be spaced from each other along a transverse direction T that is perpendicular to the longitudinal direction L. It can be said that the mating ends 156 and the ground mating ends 172 of each leadframe assembly 130 are aligned with each other along a column. The columns are oriented along the transverse direction T. Because the mating ends 156 and the ground mating ends 172 are aligned along respective columns, it can thus be said that the columns include respective ones of the signal contacts 152 and respective ones of the ground contacts 154. Each of the columns can be defined by the transverse direction T and the longitudinal direction L, and can be spaced from each other along the lateral direction A.

The leadframe assemblies 130 are spaced from each other along a lateral direction A that is perpendicular to each of the longitudinal direction L and the transverse direction T. The lateral direction A can define a plurality of rows. The mating ends 156 and the ground mating ends 172 can be further aligned with each other along the transverse direction T. The ground mating ends 172 are configured to mate with complementary mating ends of ground contacts of the second electrical connector 300. The ground mounting ends 174 are configured to be placed in physical and electrical contact with at least one drain wire 208 of the electrical cables 200. The ground mating ends 172 are oriented parallel to the ground mounting ends 174, such that the ground contacts 154 can be referred to as vertical contacts. Alternatively, the first electrical connector 100 can be configured as a right-angle electrical connector whereby the ground mating ends 172 and the ground mounting ends 174 are oriented perpendicular to each other.

The first electrical connector 100 can include at least one ground commoning member 153 that paces respective ones up to all of the ground contacts 154 that are disposed in a common one of the columns in electrical communication with each other. Otherwise stated, respective ones up to all of the ground contacts 154 that are disposed in a common one of the columns are electrically commoned together. When the ground contacts 154 are included in respective ones of the leadframe assemblies 130, respective ones or more up to all of the ground contacts 154 of each leadframe assembly 130 are placed in electrical communication with each other. For instance, the ground communing member 153 can include an electrically conductive cross-member 155 that extends along the transverse direction T and is in electrical communication with each of the ground contacts 154 that are placed in electrical communication with each other. In one example, the leadframe assemblies 130 can include a respective one of the ground commoning member 153. Alternatively, the ground commoning member 153 can be separate from the leadframe assemblies 130. In one example, the cross-member 155 can attach to the ground mounting ends 174, though it should be appreciated that the cross-member 155 can attach to the ground contacts 154 at any suitable location as desired. Alternatively, the cross-member can be spaced from the ground contacts 154, and the ground commoning member 153 can include a plurality of arms that extend from the cross member 155 to respective ones of the ground contacts 154. The ground commoning member 153 can be monolithic with the ground contacts 154. Alternatively, the cross member 155 can be separate from and attached to the ground contacts 154.

The leadframe housings 132 can be overmolded onto the respective ones of the electrical signal contacts 152 and ground contacts 154 so as to define an insert molded leadframe assembly (IMLA). Alternatively, respective ones of the electrical signal contacts 152 and ground contacts 154 can be stitched into the leadframe housing 132 or otherwise supported by the leadframe housing 132 as desired. As will become appreciated from the description below, the electrical connector 100 further includes at least one electrically conductive ground shield 177 that places the ground contacts 154 of at least one of the columns in electrical communication with each other. In particular, the ground shield 177 includes a shield body 181 having a first side 178 that is configured to physically and electrically contact at least one or more up to all of the ground contacts 154 of a first one of the columns, and a second side 179 that is opposite the first side 178 along the lateral direction A. When the columns are defined by leadframe respective assemblies 130, the ground shields 177 place the ground contacts 154 of a respective one of the leadframe assemblies 130 in electrical communication with each other. In particular, the first side 178 is configured to physically and electrically contact at least one or more up to all of the ground contacts 154 of a first one of the leadframe assemblies 130.

The electrical signal contacts 152 and ground contacts 154 can be arranged in any manner as desired. In one example, adjacent signal contacts 152 can define differential signal pairs or single ended signal contacts as desired. Differential signal pairs can be defined by signal contacts that are immediately adjacent each other such that no other electrical contacts 150 are disposed between and aligned with the immediately adjacent signal contacts 152. In one example, the electrical signal contacts 152 of each differential signal pair can be defined by the same leadframe assembly 130. Thus, the electrical signal contacts 152 of each differential signal pair can be spaced from each other along the respective column, and thus along the transverse direction T. At least one or more of the ground contacts 154 can be disposed between adjacent ones of the differential signal pairs. For instance, the ground contacts 154 can be disposed between adjacent pairs of differential signal pairs along the respective column. Alternatively, the first electrical connector 100 can be configured such that the electrical signal contacts 152 of each differential signal pair can be defined by the a pair of leadframe assemblies 130 that are immediately adjacent each other such that no other leadframe assemblies 130 are disposed therebetween. Thus, the electrical signal contacts 152 of each differential signal pair can be spaced from each other along the respective row, and thus along the lateral direction A.

The electrical connector 100 can be configured such that the electrical contacts 150 of each of the columns is staggered along the transverse direction T with respect to the electrical contacts 150 of immediately adjacent ones of the columns. Thus, the columns includes at least one electrical signal contact 152 that is not fully aligned with any of the electrical signal contacts 152 of an immediately adjacent one of the columns.

Figure 3A:
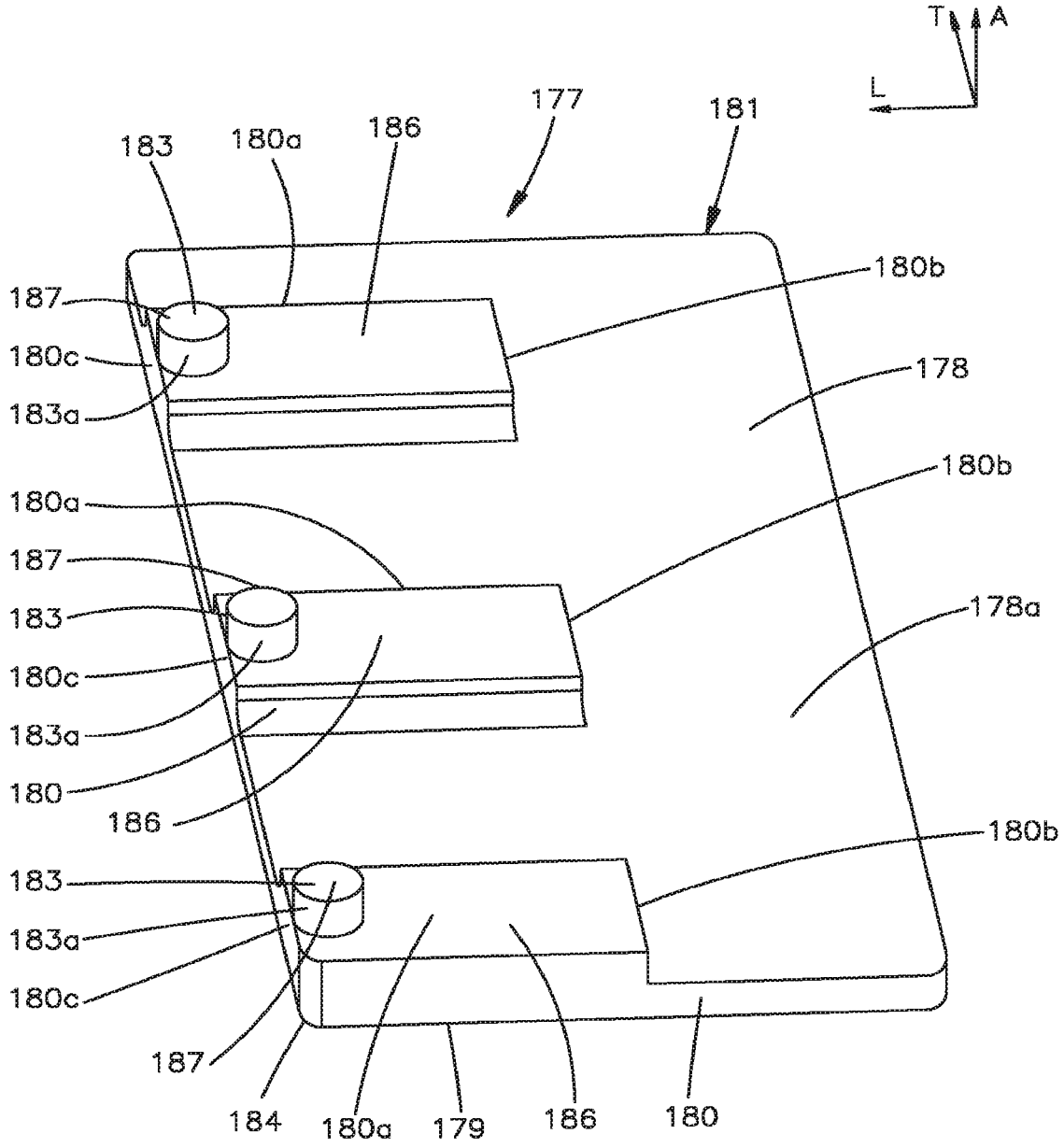
FIG. 3A is a perspective view of a ground shield of the first electrical connector illustrated in FIG. 2.
Figure 3B:
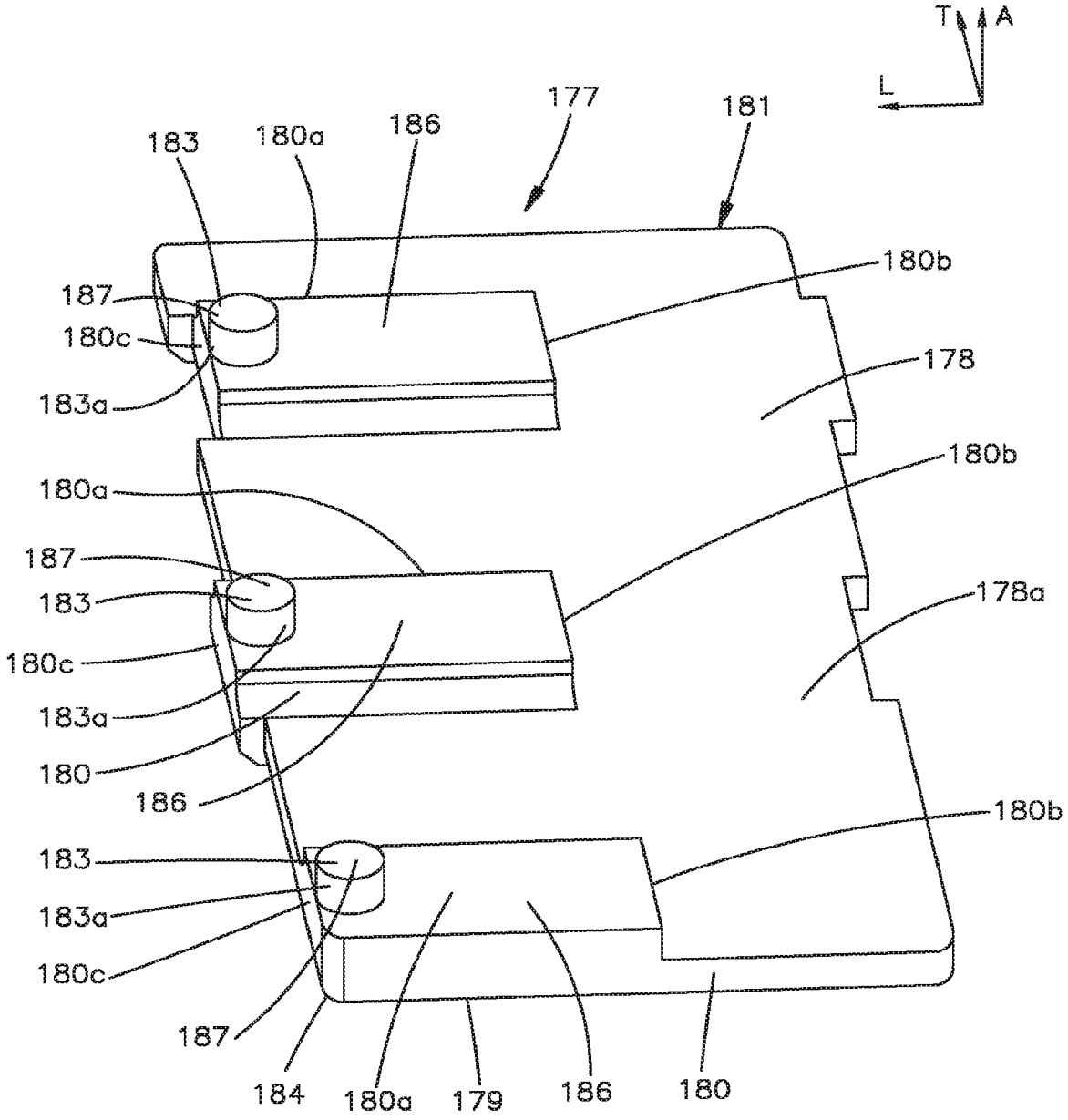
FIG. 3B is a perspective view of a ground shield similar to the ground shield illustrated in FIG. 3A, but constructed in accordance with another embodiment.

Referring also to FIGS. 3A-3B, the electrical connector 100 can further include at least one ground shield 177 that is configured to place the ground contacts 154 of a common one of the columns in electrical communication with each other. The ground shield 177 can be electrically conductive and configured to contact each of the ground contacts 154 of the common one of the columns, and, remain spaced from the signal contacts 152 so as to define a gap therebetween. Accordingly, it can be said that the ground shield 177 is electrically isolated from the signal contacts 152. The ground shield 177 can be made of any suitable electrically conductive material such as a metal. Alternatively, the ground shield 177 can be made from an electrically conductive lossy material.

The shield body 181, and thus the ground shield 177, can be configured as a plate. The shield body 181 can define a first side 178 and a second side 179 that is opposite the first side along the lateral direction A. The shield 177 includes at least one contact member 180 that extends out from the shield body 181 at the first side 178, such as a plurality of contact members 180. The contact members 180 of the ground shield can be spaced from each other along the transverse direction T. The first side 178 of the shield body 181 is recessed with respect to the contact members 180 along the lateral direction A. Otherwise stated, in one example, no part of the shield body 181 extends out with respect to the contact members 180 in a direction defined from the second side 179 toward the first side 178 along the lateral direction A. The contact members 180 can be elongate along the longitudinal direction L, or otherwise shape as desired. Each of the contact members 180 defines a contact member surface 180*a*, and the first side 178 of the shield body 181 defines a first outer surface 178*a*. The contact member surface 180*a* can be spaced from the first outer surface 178*a* along the lateral direction A. Thus, the contact members 180 can define a standoff from the first outer surface 178*a*. The contact members 180 are configured to contact the respective ground contacts 154 at the contact member surfaces 180*a*. The contact members 180 can extend out from the shield body 181. In particular, the contact members 180 can extend out from the first outer surface 178*a*. The first outer surface 178*a* can be recessed respect to the contact member surfaces 180*a* along the lateral direction A. Further, a portion of the first outer surface 178*a* extends between each of the contact members 180 along the transverse direction T. In one example, the contact member surfaces 180*a* and the first outer surface 178*a* can be parallel to each other.

The ground shield 177 is configured to be positioned between a first one of the columns and a second one of the columns of electrical contacts 150 that can each include signal contacts 152 and ground contacts 154 as described above. Each of the contact members 180 can be positioned to contact a respective at least one of the ground contacts 154 of the first one of the columns without contacting the signal contacts 152 of the first one of the columns. The contact members 180 are configured to contact at least a respective two of the ground contacts 154 so as to place the at least two of the ground contacts 154 in electrical communication with each other through the ground shield 177. The shield body 181 faces one or more up to all of the signal contacts 152 of the first one of the columns, but is spaced front the one or more up to all of the signal contacts 152 of the first one of the columns along the lateral direction A so as to define a gap therebetween. Further, the shield body 181 can face all of the electrical contacts 150 of the first one of the columns, and can be spaced along the lateral direction A from all of the signal contacts 152 of the first one of the columns so as to define a gap therebetween. Thus, the contact members 180 can be in contact with respective ones of the ground contacts 154 of the first one of the columns at respective contact locations 186. The contact locations 186 can be spaced from each other along the transverse direction T, as the ground contacts 154 of the first one of the columns are spaced from each other along the transverse direction T.

The second side 179 can be aligned with at least one or more up to all of the signal contacts 152 of the second one of the columns along the lateral direction A. The second side 179 can define a second outer surface that faces at least one or more up to all of the electrical contacts 150 of the second one of the columns. Thus, the ground shield 177 can be configured such that the first outer surface 178*a* is disposed between the contact member surfaces 180*a* and the second outer surface with respect to the lateral direction A. The second outer surface can face opposite the first outer surface 178*a* and the contact member surfaces 180*a*. The second outer surface can be spaced from each of the electrical contacts 150 of the second one of the columns along the lateral direction A so as to define a gap therebetween. Thus, the first side 178 faces and is spaced from a plurality of the signal contacts 152 of the first one of the columns to define a gap therebetween, and the second side 179 faces and is spaced from a plurality of the signal contacts 152 of the second one of the columns to define a gap therebetween. The gap extends along the lateral direction A. For instance, the first side 178 can face and be spaced from all of the signal contacts 152 of the first one of the columns, and the second side 179 can face and be spaced from all of the electrical contacts 150 of the second one of the columns with respect to the lateral direction A. The second outer surface can be parallel to each of the contact member surface 180*a* and the first outer surface 178*a*. Accordingly, the ground shield 177 is electrically isolated from all of the signal contacts 152 of the first and second ones of the columns.

As described above, the ground shield 177 can include a plurality of contact members 180 that are configured to physically and electrically contact respective ones of the ground contacts 154 of the first one of the columns. One or more up to all of the contact members 180, and thus the ground shield 177, can further include a plurality of projections 183. The projections 183 can extend out from the contact member surface 180*a* of the contact members 180 in a direction away from the second side 179. In this regard, the contact members 180 can be referred to as stand offs from which the projections 183 extend. The projections 183 are configured to be received in respective openings 188 of the ground contacts 154. In one example, the contact members 180 are configured to physically and electrically contact respective ones of the ground contacts 154 of the first one of the columns at a location proximate to their respective ground mating ends 172, thereby placing the ground contacts 154 of the first one of the columns in electrical communication with each other through the ground shield 177.

The projections 183 are configured to extend into respective ones of the openings 188 when the contact member surfaces 180*a* abut the corresponding ones of the ground contacts 154. Thus, the ground shield 177 can contact the ground contacts 154 both at the projections 183 and at the contact member surfaces 180*a*. Alternatively, the ground shied 177 can make contact with the ground contacts 154 only at the projections 183. For instance, the projections 183 can be press-fit into the respective ones of the openings 188. Thus, one or both of the projections 183 and the openings 188 can be tapered such that the projections are configured to be press-fit into the respective ground contacts 154 at the corresponding openings 188. In this regard, the contact member surfaces 180*a* are spaced from the ground contacts 154 when the projections 183 are press-fit into the ground contacts 154. Alternatively, contact members 180 can be devoid of the contact member surfaces 180*a*, such that the projections 183 extend directly out from the first side 178, and in particular out from the first outer surface 178*a*. Whether each of the contact members 180 define a contact member surface 180 or not and whether the projections 183 extend out from the contact member surfaces 180 or not, the projection 183 can be said to extend out with respect to the respective first side 178, and in particular with respect to the first outer surface 178*a*.

The projections 183 can extend out with respect to the first outer surface 178*a* along the lateral direction A. The projections 183 can be narrower than the contact member surfaces 180*a* along the transverse direction T. Further, the projections 183 are narrower than the contact member surfaces 180*a* along the longitudinal direction L. Thus, one or more up to all of the projections 183 can be fully contained between first and second external surfaces of the shield body 181 that are spaced from each other along the longitudinal direction L. In one example, the projections 183 are rigid, and thus are not configured to flex as they contact the respective ground contacts 154. The projections 183 can all be spaced from each other along the transverse direction T. Each of the projections 183 are configured to be inserted into respective one of the openings 188 of the ground contacts 154 so as to place the ground shield 177 in physical and electrical contact with the ground contacts 154 of the one of the columns. The projections 183 can have an external surface 187 that is spaced from each of the first outer surface and the contact member surface 180*a*. A distance from the first outer surface 178*a* to the external surface 187 along the lateral direction A is greater than the thickness of the ground contacts 154 along the lateral direction A. A distance from the contact member surface 180*a* to the external surface 187 along the lateral direction A is greater than the thickness of the ground contacts 154 along the lateral direction A. Accordingly, the projections 183 can be received in the openings 188.

In particular, each of the projections 183 can be inserted into respective one of the openings 188 until the respective contact member surface 180*a* contacts the corresponding ground contact 154. The contact member surface 180*a* can contact the ground contacts 154 at their intermediate portions 173. In this regard, it should be appreciated that the contact member surfaces 180*a* are aligned with respective ones of the around contacts 154, and the portion of the first outer surface 178*a* that extends between the contact members 180 is aligned with respective ones of the signal contacts 152 that are disposed between the ground contacts 154.

In one example, the projections 183 can alternatively extend from the shield body 181. For instance, the projections 183 can extend directly from the first outer surface 178*a*. Thus, the ground shield 177 can be devoid of the contact members 180. Further, the projections 183 can be tapered inwardly as they extend out from the shield body 181. Thus, the projections 183 can be press-fit in the respective ones of the openings 188.

The projections 183 can be sized and shaped in any suitable manner as desired. For instance the projections 183 can extend from the respective contact member surface 180*a* and terminate at respective exterior surfaces 187. The exterior surfaces 187 can face the lateral direction A. The exterior surfaces 187 can be parallel to each other. The exterior surfaces 187 can be planar along a respective plane that is defined by the longitudinal direction L and the transverse direction T. Thus, the exterior surfaces 187 can be parallel to each of the first and second outer surfaces. Each of the projections 183 defines an outer perimeter 183*a* that extends between the respective contact member surface 180*a* and the external surface 187. Thus, the outer perimeter 183*a* can lie on a plane that is 1) defined by the transverse direction T and the longitudinal direction L and 2) disposed between the respective contact member surface 180*a* and the exterior surface 187. In one example, the projections 183 are round. Thus, the outer perimeters 183*a* can be round in the plane. For instance, the projections 183 can be cylindrical. Thus, the outer perimeters 183*a* can be circular in the plane. As illustrated in FIG. 2, the projections 183 can be sized for insertion into respective ones of the openings 188 of the ground contacts 154 so as to contact the respective ones of the ground contacts 154 at their outer perimeters 183*a* so as to define the contact locations 186. In one example, the openings 188 and the projections can have substantially equal cross-sections such that the projections 183 can be press-fit into the openings 188.

Each of the projections 183 can extend out with respect to the first outer surface 178*a*, for instance from the respective contact member surface 180*a*, to the external surface 187 along a respective central axis 184. The central axis 184 can thus be oriented normal to the first outer surface 178*a*. Further, the central axis 178*a* can be oriented to the contact member surface 180*a*. When the projections 183 are cylindrical, the central axes can define the central axis of the respective cylinder. In one example, the central axes 184 can be oriented along the lateral direction A. As illustrated in FIG. 3A, the contact members 180 can be fully aligned with each other along the transverse direction. The contact members 180 can define a rear terminal end 180*b* and a forward terminal end 180*c* that is spaced from the rear terminal end 180*b* in the forward direction. In one example, the forward terminal ends 180*c* of all of the contact members 180 can be aligned with each other along the transverse direction T. Thus, none of the forward terminal ends 180*c* are offset along the longitudinal direction L with respect to any others of the forward terminal ends 180*c* of the ground shield 177. Accordingly, a straight line oriented along the transverse direction T does not exist that passes through one of the forward terminal ends 180*c* but not through all forward terminal ends 180*c*. Further, the projections 183 can be aligned with each other along the transverse direction T. Thus, the central axes 184 can each be aligned with each other along the transverse direction T. Otherwise stated, the central axes 184 can all lie in a common plane. Further, the outer perimeters 183*a* of the projections 183 can all be aligned with each other along the transverse direction T, such that none of the outer perimeters 183*a* is offset in the longitudinal direction L with respect to any others of the outer perimeters 183*a*. Further, the openings 188 of the ground contacts 154 extend through the ground contacts 151 along respective axes that can be aligned with each other along the transverse direction T.

Alternatively, referring now to FIG. 3B, it has been discovered that the resonant frequency of the electrical connector 100 can be shifted by positioning the projections 183 such that at least one of the contact locations 186 is offset with respect to at least one other of the contact locations 186 along the longitudinal direction L. Thus, at least one of the contact members 180 is offset from at least one other one of the contact members 180 along the longitudinal direction L. Accordingly, a straight line directed in the transverse direction T can be defined that passes through one of the contact members 180 and does not pass through at least one other one of the contact members 180 of the ground shield 177. For instance, the forward end 180*c* of the at least one offset contact member 180 can be offset in the forward direction with respect to the forward end 180*c* of at least one other one of the contact members 180. Because the contact members 180 define the contact locations 186 that contact the ground contacts 154, at least one of the contact locations 186 can be offset with respect to at least one other of the contact locations 186 along the longitudinal direction L. Accordingly a straight line directed in the transverse direction T can be defined that passes through one of the contact locations 186 and does not pass through at least one other one of the contact locations 186 of the ground shield 177.

In one example, each of the contact locations 186 is offset along the longitudinal direction L with all other immediately adjacent ones of the contact locations 186 that are immediately adjacent with respect to the transverse direction T. Thus, each of the projections 183 is offset along the longitudinal direction L with respect to all other immediately adjacent ones of the projections 183 that are immediately adjacent with respect to the transverse direction T. The term "immediately adjacent" in this context means that no other projections 183 are disposed between each of the projections 183 and the immediately adjacent projections 183. It should thus be appreciated that the contact locations 186 are positioned at least at one of a first position with respect to the longitudinal direction L and a second position with respect to the longitudinal direction L. The first and second positions can be offset from each other an offset distance of at least approximately 0.2 mm along the longitudinal direction L. The contact members 180 can contact the respective ones of the ground contacts 154 of the first one of the columns at the respective contact locations 186 that can alternate along the transverse direction T between the first position and the second position. The first and second positions can be offset by the offset distance of at least approximately 0.2 mm as described below. In one example, the first and second positions of the contact locations 186 can be defined by the forward ends 180*c* of the respective contact members 180. In one example, the first and second positions of the contact locations 186 can be defined by the respective central axes 184. In another example, the first and second positions of the contact locations 186 can be defined by the forward end of the perimeters 183*a* of the projections 183.

Further, the projections 183 can be spaced from the forward end 180*c* of the respective contact members 180 the same distance in the longitudinal direction L. Accordingly, with continuing reference to FIG. 3B, at least one of the projections 183 is offset from at least one other one of the projections 183 along the longitudinal direction L. Accordingly, a straight line directed in the transverse direction T can be defined that passes through one of the projections 183 and does not pass through at least one other one of the projections. Thus, at least one of the central axes 184 can be offset with respect to at least one other of the central axes 184 along the longitudinal direction L. Otherwise stated, a straight line oriented along the transverse direction that passes through one of the central axes 184 does not pass through all of the central axes 184. Further, the forward end of the outer perimeter 183*a* of at least one of the projections 183 can be offset with respect to the forward end of the outer perimeter 183*a* of at least one other of the projections 183 with respect to the longitudinal direction L. Further, the openings 188 of the ground contacts 154 extend through the ground contacts 154 along respective axes. The axis of at least one of the openings 188 can be offset with respect to the central axis of at least one other of the openings 188 with respect to the longitudinal direction L.

The distance of the offset along the longitudinal direction L can be any suitable distance as desired. For instance, it has been discovered that the distance between the ground commoning and the mating interface of the connector 100 is directly related to the frequency of a crosstalk resonance using a half wave equation. When the distance is consistent between all differential signal pairs, the resonant frequency is also consistent or all aggressors that inject noise onto a victim differential signal pair. By changing the location of the ground commoning to create an offset distance of as little as approximately 0.2 mm, the resonant frequency of all aggressors will shift enough so that they are not adding up causing a large crosstalk spike in power sum crosstalk on the victim differential signal pair. This can result in significant performance increases of the electrical connector 100. Accordingly, the offset of at least one of the contact members 180 with respect to at least one other of the contact members 180 along the longitudinal direction L can be at least approximately 0.2 mm. "Approximately" in this context refers to a distance suitable to cause the resonant frequency to shift as described above. Similarly, the projections 183 of adjacent contact members 180 can be offset from each other along the longitudinal direction L a distance of at least approximately 0.2 mm.

As described above, the electrical connector 100 can include a plurality of ground shields 177 that are disposed between adjacent ones of the columns so as to contact the ground contacts of one of the columns as described above. In particular, each of the ground shields 177 include projections 183 that are inserted into respective openings 188 of the ground contacts 154 of a corresponding one of the plurality of columns. Thus, a second ground shield 177 can place the ground contacts of the second one of the columns in electrical communication with each other as described herein. It should be appreciated that the ground shields 177 can be spaced from each other along the lateral direction A. Alternatively, the ground shields 177 can contact each other so as to place the electrical ground contacts 154 of each of the columns in electrical communication with each other. For instance, projections of the ground shields can contact the second outer surface of an adjacent one of the ground shields 177. For instance, the external surfaces 187 can contact the second outer surface of the adjacent one of the ground shields 177. It should thus be appreciated that the ground shields 177 can place separate ground contacts 154 of a select column of contacts 150 in electrical communication with each other, and can also place the ground contacts of the select column in electrical communication with one or more up to all of the ground contacts of a second column. The second column can be disposed adjacent the select column, such that no other columns of electrical contacts 150 are disposed between the first and second columns.

It should be appreciated that a method can be provided for shifting a resonance frequency of the electrical connector 100. The method can include the step of placing the at electrically conductive ground shield 177 between first and second columns of electrical contacts 150 of the electrical connector 100 with respect to the lateral direction A. As described above, each column can include a respective plurality of electrical signal contacts 152 and ground contacts 154 spaced from each other along the transverse direction T. The method can include the step of contacting ones of the ground contacts 154 of the first column at respective contact locations 186. One of the contact locations 186 can be offset with respect to at least one other of the contact locations 186 along the longitudinal direction L. After the contacting step, the ground shield 177 can be spaced from the signal contacts 152 of each of the first and second columns to define respective gapes therebetween. The contacting step can include inserting each of a plurality of the projections 183 of the ground shield 177 into respective openings 188 of the ground contacts 154.

Figure 4:
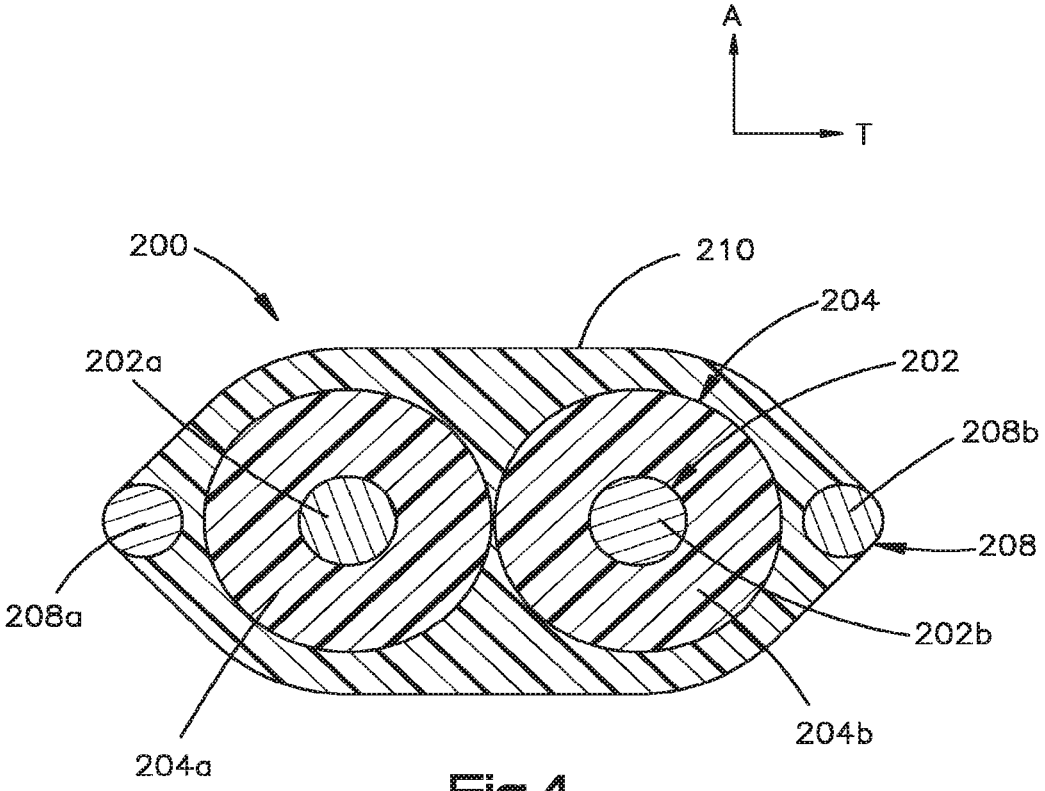
FIG. 4 is a sectional side elevation view of a cable configured to be mounted to the first electrical connector as illustrated in FIG. 1.

As illustrated in FIG. 4, each of the electrical cables 200 can include at least one electrical signal conductor 202. In one example, each of the electrical cables 200 can include a pair of signal conductors including a first signal conductor 202*a* and a second signal conductor 202*b*. The first and second signal conductors 202*a* and 202*b* can define a differential signal pair, or can define single-ended electrical signal conductors as desired. Each of the plurality of cables 200 can further include at least one electrically insulative layer 204 that surrounds the at least one signal conductor. The electrically insulative layer 204 can be dielectric and electrically insulative. In one example, each of the plurality of cables 200 can include a first inner electrically insulative layer 204*a* that surrounds the first signal conductor 202*a* and a second inner electrically insulative layer 204*b* that surrounds the second signal conductor 202*b*. The first and second insulative layers 204*a* and 204*b* surround the respective first and second signal conductors 202*a* and 202*b* with respect to a plane that is oriented normal to a direction of elongation of the respective first and second signal conductors 202*a* and 202*b*.

With continuing reference to FIG. 4, each of the plurality of cables 200 can further include an exterior insulation layer 210 that is dielectric and electrically insulative, and surrounds each of the first and second insulative layers 204*a* and 204*b*. The first and second insulative layers 204*a* and 204*b* and the exterior insulation layer 210 can be constructed of any suitable dielectric material, such as plastic. Each of the plurality of cables 200 can further include at least one drain wire 208. For instance, each of the plurality of cables 200 can include a first drain wire 208*a* and a second drain wire 208*b*. The first and second drain wires 208*a* and 208*b* can be surrounded by the exterior insulation layer 210. Each of the first and second drain wires 208*a* and 208*b* can be supported by the exterior insulation layer 210 at a location such that each of the first and second signal conductors 202*a* and 202*b* is disposed between the first and second drain wires 208*a* and 208*b*. In particular, the electrical cables can be oriented such that each of the first and second signal conductors 202*a* and 202*b* is disposed between the first and second drain wires 208*a* and 208*b* with respect to the transverse direction T. Further, each of the first and second electrically insulative layers 204*a* and 204*b* can be disposed between the first and second drain wires 208*a* and 208*b*. The center of each of the first and second signal conductors 202*a* and 202*b* can be spaced from, and aligned with, the center of the other of the first and second signal conductors 202*a* and 202*b* along the transverse direction T. Each of the electrical cables 200 can further include an electrically conductive ground jacket that places the drain wires 208*a* and 208*b* in electrical communication with each other, and provides a shield with respect to crosstalk between respective ones of the electrical cables 200. It should be appreciated that the electrical cables 200 can be constructed in any manner as desired. For instance, the electrical cables 200 can include a single drain wire 208.

The first and second electrical signal conductors 202*a* and 202*b* can be mounted to respective ones of the electrical signal contacts 152 of the first electrical connector 100. Similarly, the first and second drain wires 208*a* and 208*b* can be mounted to respective ones of the electrical ground contacts 154 of the first electrical connector 100. For instance, respective exposed ends of the conductors 202 can be exposed and configured to attach to respective mounting ends of signal contacts, and a portion of the drain wires can be exposed and configured to attach to respective mounting ends of ground contacts.

In one example, the first and second electrical signal conductors 202*a* and 202*b* can be mounted to respective ones of the electrical signal contacts 152 of the first electrical connector 100. For instance, each of the first and second electrical signal conductors 202*a* and 202*b* can define respective exposed ends 214 that extend out from the respective first and second insulative layers 204*a* and 204*b* (see FIG. 2). The exposed ends 214 are mounted to respective ones of the electrical signal contacts 152 of the first electrical connector 100. For instance, the exposed end 214 of the first electrical signal conductor of 202*a* of a respective one of the cables 200 can be mounted to a first one of the electrical signal contacts 152 of the first electrical connector 100. In particular, the exposed end 214 of the first electrical signal conductor 202*a* can be attached to the mounting end of the first one of the electrical signal contacts 152. Thus, the first electrical signal conductor 202*a* is placed in electrical communication with the first one of the electrical signal contacts 152. Similarly, the exposed end 214 of the second electrical signal conductor of 202*b* of the respective one of the cables 200 can be mounted to a second one of the electrical signal contacts 152 of the first electrical connector 100 that is immediately adjacent the first one of the electrical signal contacts 152. For instance, the exposed end 214 of the second electrical signal conductor 202*b* can be attached to the mounting end of the second one of the electrical signal contacts 152. Thus, the second electrical signal conductor 202*b* is placed in electrical communication with the second one of the electrical signal contacts 152.

Further, the first and second drain wires 208*a* and 208*b* can be mounted to respective ones of the electrical ground contacts 154 of the first electrical connector 100. For instance, each of the first and second drain wires 208*a* and 208*b* can define respective exposed ends 215 (see FIG. 2) that are mounted to respective ones of the electrical ground contacts 154 of the first electrical connector 100. For instance, the exposed end 215 of the first drain wire 208*a* of the respective one of the cables 200 can be mounted to a first one of the electrical ground contacts 154 of the first electrical connector 100. In particular, the exposed end 215 of the first drain wire 208*a* can be attached to the mounting end of the first one of the electrical ground contacts 154. Thus, the first drain wire 208*a* is placed in electrical communication with the first one of the electrical ground contacts 154. Similarly, the exposed end 215 of the second drain wire 208*b* of the respective one of the cables 200 can be mounted to a second one of the electrical ground contacts 154 of the first electrical connector 100 that is positioned such that the first and second ones of the electrical signal contacts 152 are disposed between the first and second ones of the ground contacts 154 with respect to the transverse direction T. For instance, the exposed end 215 of the second drain wire 208*b* can be attached to the mounting end of the second one of the electrical ground contacts 154. Thus, the second drain wire 208*b* is placed in electrical communication with the second one of the electrical ground contacts 154.

It should be appreciated that the first drain wire 208*a* of a first one of the electrical cables 200 can be mounted to the same one of the electrical ground contacts 154 that the second drain wire 208*b* of a second electrical cable 200 is mounted to. Thus, it can be said that the first drain wire 208*a* of the first one of the electrical cables 200 and the second drain wire 208*b* of the second one of the electrical cables 200 can be mounted to a common one of the ground contacts 154. The first and second cables 200 can be disposed immediately adjacent each other along the transverse direction T. Otherwise stated, first and second adjacent ones of the electrical cables 200 can include a drain wire that is mounted to a common one of the ground contacts 154, particularly to the ground mounting end 174 of the common one of the ground contacts 154.

The first electrical connector assembly 22 can further include an outermost electrical cable 201 that can be configured as a single conductor 202, which can be a widow conductor that can be configured to be a single-ended signal conductor, a low speed or low frequency signal conductor, a power conductor, a ground conductor, or some other utility conductor that does not define a differential pair.

Referring again to FIG. 1, the second electrical connector 300 includes a connector housing 302 that supports a plurality of electrical contacts 304. The second electrical connector 300 defines a mating interface 306 that is configured to mate with the first electrical connector 100. The electrical contacts 304 include signal and ground contacts that are configured to mate with respective ones of the signal and ground contacts 152 and 154, respectively, when the first and second electrical connectors 100 and 300 are mated to each other, thereby placing the electrical cables 200 in electrical communication with the substrate 400.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. For instance, it should be appreciated that structure and methods described in association with one embodiment are equally applicable to all other embodiments described herein unless otherwise indicated. Those skilled in the relevant art, having the benefit of the teachings of this specification, may effect numerous modifications to the invention as described herein, and changes may be made without departing from the spirit and scope of the invention, for instance as set forth by the appended claims.

What is claimed:

1. An electrical connector comprising:

an electrically insulative connector housing;

a plurality of electrical signal contacts supported by the connector housing, each of the signal contacts having a mating end and a mounting end;

a plurality of ground contacts supported by the connector housing, each of the ground contacts having a mating end and a mounting end, wherein the electrical connector defines a plurality of columns that are spaced from each other along a lateral direction and each includes the mating ends of respective ones of the plurality of signal contacts and the mating ends of respective ones of the plurality of ground contacts;

an electrically conductive ground member disposed between a first one of the columns and a second one of the columns with respect to the lateral direction, the electrically conductive ground member having a body that has a first side and a second side opposite the first side along the lateral direction, wherein the electrically conductive ground member includes a plurality of projections that extend out from a first side of the body and extend into a respective plurality of openings in a respective at least two of the ground contacts, respectively, of the first one of the columns, and the first side of the body faces at least one of the signal contacts of the first one of the columns and is spaced along the lateral direction from the at least one of the signal contacts of the first one of the columns so as to define a gap therebetween, with first and second projections of the plurality of projections spaced from one another along a transverse direction perpendicular to the lateral direction;

a first leadframe assembly that includes a first leadframe housing and the mating ends of the plurality of signal contacts and the mating ends of the plurality of ground contacts of the first one of the columns; and a second leadframe that includes a second leadframe housing and the mating ends of the plurality of signal contacts and the mating ends of the plurality of ground contacts of the second one of the columns.

2. The electrical connector as recited in claim 1, wherein the mating ends of the plurality of signal contacts and the mating ends of the plurality of ground contacts of the first one of the columns are arranged in a pattern in a first transverse direction that is oriented along the transverse direction, and the mating ends of the plurality of signal contacts and the mating ends of the plurality of ground contacts of the second one of the columns are arranged in the pattern in a second transverse direction that is opposite the first transverse direction and oriented along the transverse direction.

3. The electrical connector as recited in claim 2, wherein the electrically conductive ground member is a first electrically conductive ground member supported by the first leadframe housing, the body is a first body, the plurality of projections are a first plurality of projections that extend into a respective first plurality of openings in a respective at least two of the ground contacts of the first leadframe assembly, and the first body faces at least one of the signal contacts of the first leadframe assembly and is spaced along the lateral direction from the at least one of the signal contacts of the first leadframe assembly so as to define a gap therebetween.

4. The electrical connector as recited in claim 3, wherein the first leadframe housing is a first frame having a first opening that is open to the signal contacts and ground contacts of the first leadframe assembly, and the first electrically conductive ground member is seated in the first frame.

5. The electrical connector as recited in claim 3, wherein:

the second leadframe assembly comprises the signal contacts of the second one of the columns and the ground contacts of the second one of the columns, all supported by the second leadframe housing; and the electrical connector further comprises a second electrically conductive ground member supported by the second leadframe housing, the second electrically conductive ground member having a second body that has a first side and a second side opposite the first side along the lateral direction, wherein the second electrically conductive ground member includes a second plurality of projections that extend out with respect to the second body and extend into respective plurality of openings in a respective at least two of the ground contacts of the second leadframe assembly, and the second body faces at least one of the signal contacts of the second leadframe assembly and is spaced along the lateral direction from the at least one of the signal contacts of the second leadframe assembly so as to define a gap therebetween.

6. The electrical connector as recited in claim 5, wherein the second electrically conductive ground member is disposed between the second one of the columns and a third one of the columns that is positioned such that the second one of the columns is disposed between the first one of the columns and the third one of the columns, the third one of the columns including respective ones of the plurality of signal contacts and respective ones of the plurality of ground contacts.

7. The electrical connector as recited in claim 5, wherein the mating ends of the signal contacts and ground contacts of the first leadframe assembly comprise tips that are convex with respect to a first lateral side of the first leadframe assembly, and concave with respect to a second lateral side of the first leadframe assembly that is opposite the first lateral side of the first leadframe assembly, and the first electrically conductive ground member is supported by the first leadframe housing at the first lateral side of the first leadframe assembly.

8. The electrical connector as recited in claim 1, wherein the plurality of openings are round, and the plurality of projections are round.

9. The electrical connector as recited in claim 1, further comprising a plurality of electrical cables coupled to the plurality of electrical signal contacts and the plurality of ground contacts of the first one of the columns, each of the plurality of electrical cables comprising:

a pair of signal conductors coupled to a respective pair of the plurality of electrical signal contacts of the first one of the columns; and a ground conductor coupled to a respective one or more of the plurality of ground contacts of the first one of the columns.

10. The electrical connector as recited in claim 9, wherein:

the ground conductor of each of the plurality of electrical cables comprises an electrically conductive cable shield, the respective one or more of the plurality of ground contacts of the first one of the columns are coupled to the electrically conductive cable shield, and the electrically conductive ground member is coupled to the electrically conductive cable shield via the respective one or more of the plurality of ground contacts of the first one of the columns.

11. An electrical connector comprising:

an electrically insulative connector housing;

a plurality of electrical signal contacts supported by the connector housing, each of the signal contacts having a mating end and a mounting end;

a plurality of ground contacts supported by the connector housing, each of the ground contacts having a mating end and a mounting end, wherein the electrical connector defines a plurality of columns that are spaced from each other along a lateral direction and each includes the mating ends of respective ones of the plurality of signal contacts and the mating ends of respective ones of the plurality of ground contacts;

a first electrically conductive ground member disposed between a first one of the columns and a second one of the columns with respect to the lateral direction, the first electrically conductive ground member having a first body that has a first side and a second side opposite the first side along the lateral direction, wherein the first electrically conductive ground member includes a first plurality of projections that extend out with respect to the first body and extend into a respective first plurality of openings in a respective at least two of the ground contacts, respectively, of the second one of the columns, and the first body faces at least one of the signal contacts of the second one of the columns and is spaced along the lateral direction from the at least one of the signal contacts of the second one of the columns so as to define a gap therebetween;

a second electrically conductive ground member disposed between the second one of the columns and a third one of the columns with respect to the lateral direction, the second electrically conductive ground member having a second body that has a first side and a second side opposite the first side along the lateral direction, wherein the second electrically conductive ground member includes a second plurality of projections that extend out with respect to the second body and extend into a respective second plurality of openings in a respective at least two of the ground contacts, respectively, of the second one of the columns, and the second body faces at least one of the signal contacts of the second one of the columns and is spaced along the lateral direction from the at least one of the signal contacts of the second one of the columns so as to define a gap therebetween;

a leadframe assembly that includes a leadframe housing and the mating ends of the plurality of signal contacts and the mating ends of the plurality of ground contacts of the second one of the columns, wherein the leadframe assembly supports the first electrically conductive ground member and the second electrically conductive ground member on opposite sides of the leadframe assembly.

12. The electrical connector as recited in claim 11, wherein the first plurality of openings are round, and the first plurality of projections are round.

13. The electrical connector as recited in claim 11, further comprising a plurality of electrical cables coupled to the plurality of electrical signal contacts and the plurality of ground contacts of the second one of the columns, each of the plurality of electrical cables comprising:

a pair of signal conductors coupled to a respective pair of the plurality of electrical signal contacts of the second one of the columns; and a ground conductor coupled to a respective one or more of the plurality of ground contacts of the second one of the columns.

14. The electrical connector as recited in claim 13, wherein:

the ground conductor of each of the plurality of electrical cables comprises an electrically conductive cable shield, the respective one or more of the plurality of ground contacts of the second one of the columns are coupled to the electrically conductive cable shield, and the first electrically conductive ground member is coupled to the electrically conductive cable shield via the respective one or more of the plurality of ground contacts of the second one of the columns.

15. First and second electrically conductive ground members for an electrical connector, the first electrically conductive ground member comprising:

a first side having a first outer surface;

a plurality of first projections that extend out with respect to the first outer surface along a lateral direction to respective first outermost ends, and are each configured for inserting into a respective first plurality of openings in a plurality of ground contacts of a column of the electrical connector, a second side having a second outer surface that is opposite the first outer surface, wherein the plurality of first projections extend out with respect to the first outer surface in a direction away from the second outer surface; and the second electrically conductive ground member comprises:

a first side having a first outer surface;

a plurality of second projections that extend out with respect to the first outer surface of the second electrically conductive ground member along the lateral direction to respective second outermost ends, and are each configured for inserting into a respective second plurality of openings in the plurality of ground contacts of the column of the electrical connector, a second side having a second outer surface that is opposite the first outer surface of the second electrically conductive ground member, wherein the plurality of second projections of the second electrically conductive ground member extend out with respect to the first outer surface of the second electrically conductive ground member in a direction away from the second outer surface of the second electrically conductive ground member.

16. The first and second electrically conductive ground members as recited in claim 15, wherein:

the first electrically conductive ground member comprises a plurality of first contact members that extend out with respect to the first outer surface and are each configured to contact a respective one of the plurality of ground contacts; and the second electrically conductive ground member comprises a plurality of second contact members that extend out with respect to the first outer surface of the second electrically conductive ground member and are each configured to contact the respective one of the plurality of ground contacts.

17. The first and second electrically conductive ground members as recited in claim 16, wherein each of the plurality of first contact members is a first contact member surface, such that the first projections extend from respective ones of the first contact member surfaces, and each of the plurality of second contact members is a second contact member surfaces, such that the second projections extend from respective ones of the second contact member surfaces.

18. The first and second electrically conductive ground members as recited in claim 17, wherein the first contact member surfaces are parallel to the first outer surface of the first ground member, and the second contact member surfaces are parallel to the first outer surf ace of the second ground member.

19. A leadframe assembly for an electrical connector, the leadframe assembly including an electrically nonconductive leadframe housing, and signal contacts and ground contacts supported by the leadframe housing, wherein a first electrically conductive ground member as recited in claim 15 is supported by the leadframe housing such that the plurality of first projections extend into a respective plurality of first openings in the ground contacts, and a second electrically conductive ground member as recited in claim 15 is supported by the leadframe housing such that the plurality of second projections extend into a respective plurality of second openings in the ground contacts.

20. The leadframe assembly of claim 19, wherein the plurality of first projections and the plurality of second projections are round, and the plurality of first openings and the plurality of second openings are round.

21. The leadframe assembly as recited in claim 19, further comprising a plurality of electrical cables coupled to the signal contacts and the ground contacts, each of the plurality of electrical cables comprising:

a pair of signal conductors coupled to a respective pair of the signal contacts; and a ground conductor coupled to a respective one or more of the ground contacts.

22. The leadframe assembly as recited in claim 21, wherein:

the ground conductor of each of the plurality of electrical cables comprises an electrically conductive cable shield, the respective one or more of the ground contacts are coupled to the electrically conductive cable shield, and the first electrically conductive ground member is coupled to the electrically conductive cable shield via the respective one or more of the ground contacts.

* * * * *